US005314132A

United States Patent [19]

Ando et al.

[11] Patent Number: 5,314,132

[45] Date of Patent: May 24, 1994

[54] METHOD FOR CHANGING SPOOLS AND APPARATUS THEREFOR

[75] Inventors: Masatoshi Ando; Hiromine Mochizuki, both of Hyogo; Mitsuo Yamamoto, Hiroshima, all of Japan

[73] Assignees: Mitsubishi Jukogyo Kabushiki Kaisha; Kanzaki Paper Mfg. Co., Ltd., both of Tokyo, Japan

[21] Appl. No.: 849,936

[22] Filed: Mar. 12, 1992

[30] Foreign Application Priority Data

Nov. 26, 1991 [JP] Japan ..... 3-311074
Nov. 26, 1991 [JP] Japan ..... 3-311075
Jan. 7, 1992 [JP] Japan ..... 4-018219

[51] Int. Cl.[5] ..... B65H 18/16; B65H 19/26; B65H 19/28

[52] U.S. Cl. ..... 242/56 R; 242/65

[58] Field of Search ..... 242/56 R, 56 A, 56.2, 242/56.6, 65

[56] References Cited

U.S. PATENT DOCUMENTS 4,444,362 4/1984 Karr ..... 242/56.6
4,445,646 5/1984 Karr et al. ..... 242/56 R
4,458,852 7/1984 Calvert et al. ..... 242/56 A
4,516,736 5/1985 Andersen ..... 242/56.2
4,695,004 9/1987 Grossmann et al. ..... 242/56 R

*Primary Examiner*—John M. Jillions
*Attorney, Agent, or Firm*—McAulay Fisher Nissen Goldberg & Kiel

[57] ABSTRACT

A method for changing spools in which a sheet continuously supplied to a reel drum is wound onto a new spool, comprising the steps of bringing the new spool held on an arm at a waiting position into contact with the reel drum; cutting the center part of the sheet with two cutting devices along two approximately parallel cutting lines in the running direction of the sheet at a location on the reel drum upstream in the running direction of the sheet; supplying an adhesive to an area between the cutting lines and letting the adhesive adhere onto a surface of the new spool; and moving said two cutting devices toward the two respective edges of the sheet so as to cut the sheet into a triangular shape. An apparatus for changing spools is equipped with a holder for holding the new spool at a waiting position and bringing the new spool into contact with the reel drum when a new spool replaces the old one; two cutting devices installed so as to be able to contact with and move away from the sheet and to move from the central part of the sheet to the respective side edges at an upstream position in the direction of the sheet movement on the reel drum; and a supplier for supplying an adhesive material onto the sheet surface installed between the cutting devices and the reel drum.

9 Claims, 6 Drawing Sheets

METHOD FOR CHANGING SPOOLS AND APPARATUS THEREFOR

FIELD OF THE INVENTION AND RELATED ART STATEMENT

The present invention relates to a method for changing reels for taking up paper and an apparatus therefor, which may be applied to a winder used for a paper machine, or for a coating apparatus in which a pigment coating liquid is coated to produce coated paper, or for an on-machine coating type paper machine in which coated paper is produced by applying pigment liquid coating subsequent to paper production.

While various types of winders are used in paper mills, level rail type winders have become most common in recent years because the velocity of moving sheet is becoming higher and because the sheet width tends to be broader. In a level reel type winder, a new spool on the primary arm held at a waiting position above the reel drum is urged toward the reel drum by the action of a pressure contact device together with a slight rotation of the primary arm. The sheet continuously conveyed is usually cut by a paper cutting knife and an air jet from a nozzle, and then wound onto the new spool. The roll, after a desired amount of paper is wound on the old spool, is moved backward by rolling it on a horizontal rail so as to separate from the reel drum by means of a secondary arm. Then, the new spool is lowered onto the horizontal rail by means of the primary arm and urged toward the reel drum by the secondary arm. Thus, the spool change is completed.

However, since the sheet which is continuously conveyed is cut by a paper cutting knife and an air jet from a nozzle and then wound onto the new spool in the conventional level rail type winder described above, the shape of a sheet end is not the same after each spool change operation. Furthermore, a strong paper sheet cannot be cut well in this manner. Thus, a paper sheet cannot be wound smoothly onto a new spool and other related problems have been noted.

Some sheets have the problem of breaking shortly after they are successfully wound around the new spool, and thus longer periods of time are required for changing spools as a result. Furthermore a sheet tends to be easily folded at its beginning end at the initial stage of winding. Because of a longer period of time required for changing spools, in the case of a paper machine, for example, a whole sheet continuously sent from the preceding steps during such a time period becomes wasted, and the production efficiency therefore has been low, and a significant amount of time is wasted for taking care of defective sheets.

Moreover, the folding of paper sheets occurring at the earliest stage of winding tends to cause defects, such as swelling and wrinkles, in lower layers (underlayers) of the wound paper. In addition, such sheet folding is often experienced near the center part of the spool, and therefore layers of the sheet are formed in such a manner that the sheet is continuously wound and layered on top of the folded sheet. The internal compression forces at these portions become strong and the layers are susceptible to crushing. Due to such compression forces, the so-called mirror surface (edge surface) of the wound roll tends to be disturbed in a rose shape (sometimes called blooming, star, or star shape), yielding a poorly wound roll, a large part of which cannot be used as a product.

OBJECT AND SUMMARY OF THE INVENTION

An object of the present invention is to provide a method for the changing of spools and an apparatus therefor in which the winding of paper to a new spool when a wound roll is replaced by a fresh spool takes only a short period of time, and in which products free from such defects and problems as mentioned above can be produced in a stable manner.

For this purpose, the present invention provides a method for changing spools in which a paper sheet which is continuously sent to a reel drum can be wound around a new spool, which method comprises the steps of bringing the new spool held on an arm at a waiting position into contact with the reel drum, cutting the central portion of the sheet along two parallel lines in the direction of sheet movement with two cutting devices at a position upstream from the reel drum in flow direction of the sheet, supplying an adhesive to the area formed between the two cut lines, transferring the sheet to the new spool by adhering it onto the surface of the new spool, subsequently moving the two cutting devices toward the respective edge of the sheet to cut the sheet into a triangular shape so as to completely separate a new sheet from the old sheet and winding the new sheet onto the new spool. Also, in this method, the adhesive can be supplied to a position between the cutting lines and between the new spool and the cut old sheet.

The present invention also provides an apparatus for carrying out the above method for changing spools which comprises a holder for holding a new spool at the waiting position and for bringing the new spool into contact with the reel drum for changing spools. Two cutting devices are provided which are capable of contacting and separating from a sheet at an upstream position in the flow of the sheet from the reel drum. Each of the cutting devices is disposed so as to be able to move from the central portion of the sheet to the edge portion thereof. An adhesive applicator is further provided for supplying an adhesive to the sheet surface which applicator is located between the cutting devices and the reel drum.

According to these method and apparatus, the sheet is cut along two parallel cut lines and subsequently into a triangular shape; thus, the winding of the sheet around the new spool can be made very smoothly.

In a preferred embodiment, the method of the present invention is provided with a step in which the portion of the sheet between the two cut lines which is adhered to the new spool is cut at a tip end part of the adhered portion by another cutting device installed separately. Such a cutting device has a jet nozzle opening toward the central part of the sheet surface at a location slightly downstream from the contact point at which the new spool contacts the reel drum. This jet cutting device is capable of moving away from the movement locus of the new spool on the reel drum while it is not operating.

According to the above-described method for changing spools and apparatus therefor, the sheet between the parallel lines are cut in a more assured manner.

In another preferred embodiment, the two cutting devices comprise rotational circular blades of which angle may be adjusted within the plane of sheet surface so that the blades may be held approximately parallel to their cut lines, so that the sheet can be cut more sharply.

In still another preferred embodiment, the two cutting devices use a jet of high pressure water.

Other objects and advantages of the present invention will become apparent from the following detailed description.

DETAILED DESCRIPTION OF PREFERRED EMBODIMENTS

Figure 1:
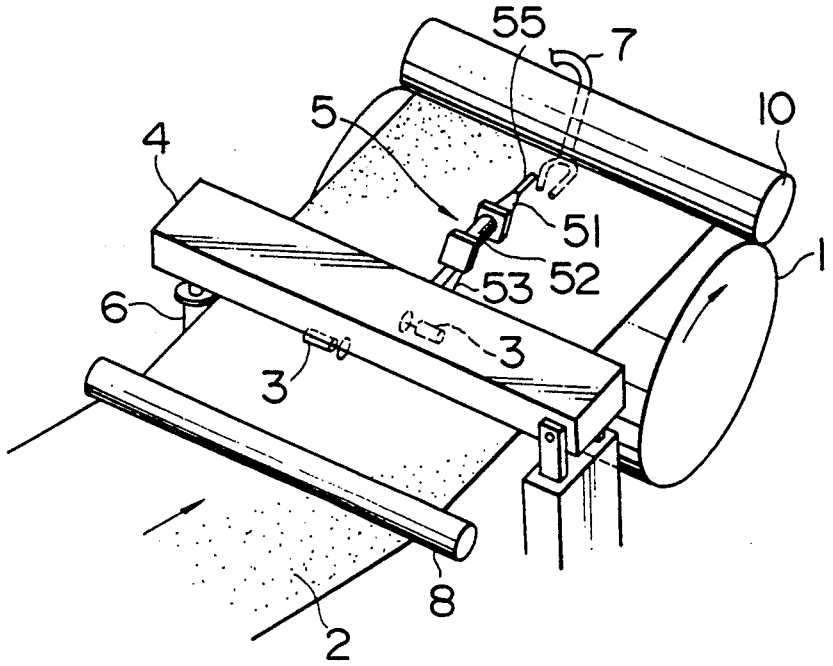
FIG. 1 is a perspective view showing the outline of the whole assembly of an embodiment of the spool exchange apparatus according to the present invention.
Figure 2:
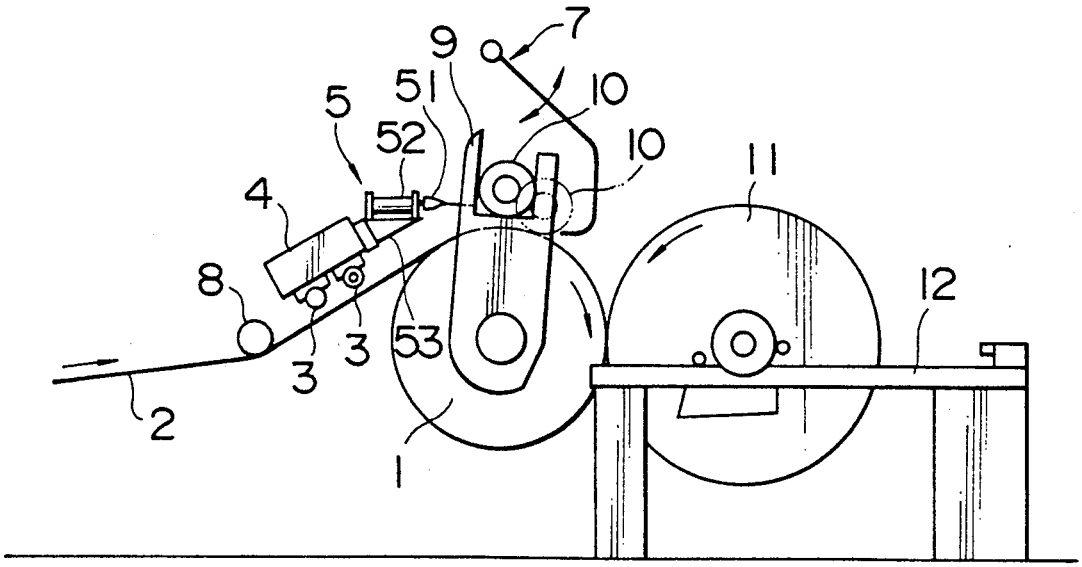
FIG. 2 is a side view of FIG. 1.

Referring FIGS. 1 and 2, numerical reference 1 indicates a reel drum which winds a sheet 2 sent from the upstream through a press roll 8 onto a spool which is in contact with the reel drum 1 and rotating. A new spool 10 is located at a waiting position and held by a primary arm 9 as shown by the solid line in FIG. 2 while the old winding roll 11 is taking up the sheet and is positioned on a horizontal rail 12. When the old winding roll 11 is, after a desired amount of sheet 2 has been wound thereon, replaced by a new spool, the primary arm 9 rotates clockwise, and the new spool 10 is brought into contact with the outer surface of the reel drum 1, as shown by the broken line FIG. 2, and rotates in the direction opposite to the rotation of the reel drum 1.

Figure 3:
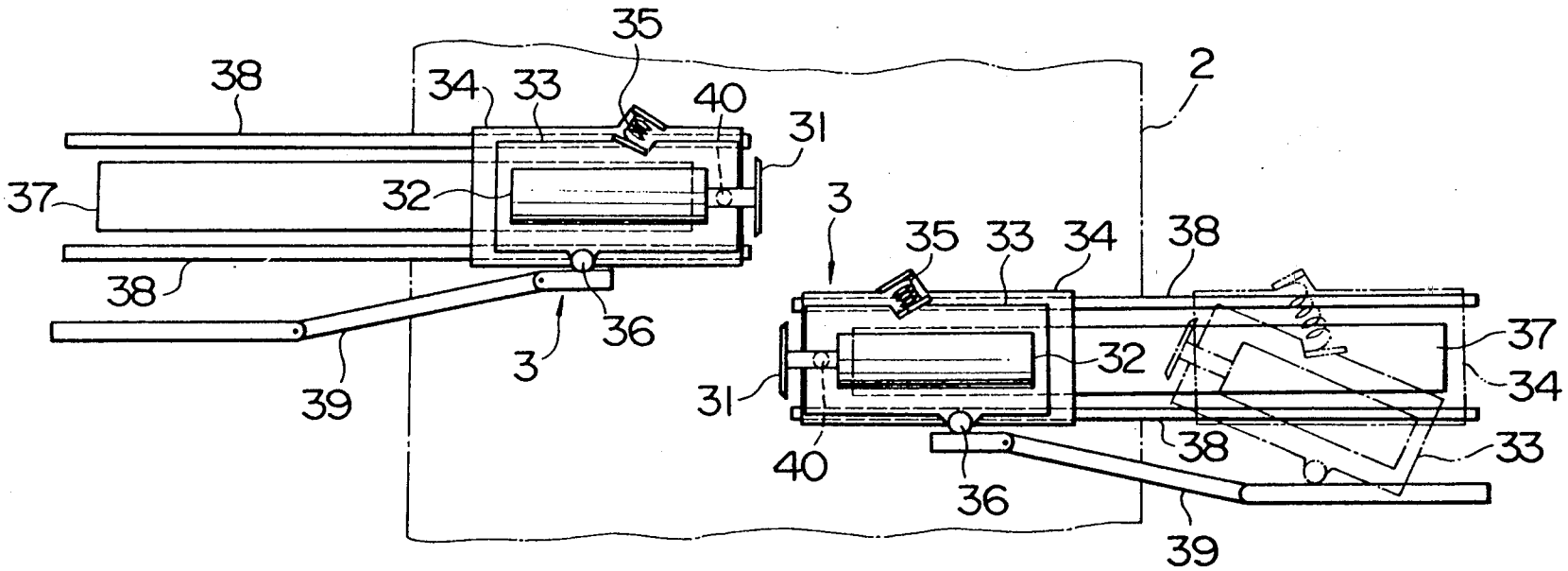
FIG. 3 is a view observing the cutting devices 3 from the sheet side (from the under side)
Figure 4:
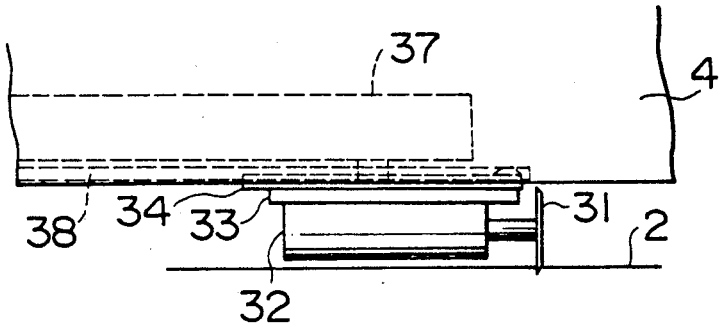
FIG. 4 is a side view of the cutting devices 3.

Numerical reference 3 indicates a pair of cutting devices. We will describe them in the following by referring to FIGS. 3 through 5. The cutting devices 3, 3 are installed at an opening disposed on the under side of a lift beam 4. The lift beam 4 swings upward and downward by way of an air cylinder 6 installed at one end of the beam, and its other end is a supporting point as shown in FIG. 1. To the lift beam 4, a pair of rails 38, 38 are fixed and a cradle 34 is slidably fitted onto the rails. In the cradle 34, a rotatable base 33 is mounted so as to rotate freely around the fulcrum of a pin 40 equipped with thrust bearings. On the rotatable base 33, a motor 32 is fixed, and a rotational circular blade 31 is affixed to the shaft of the motor 32.

Furthermore, a guide roller 36 is disposed on a side of the rotatable base 33. The guide roller 36 is, together with the rotatable base 33, pushed against a guide rail 39 fitted in the lift beam 4 by means of a spring 35 fixed between the rotatable base 33 and the cradle 34. The guide rail 39 consists of three members, each of which is connected with another in a freely rotatable manner; while the innermost member (near the center of the sheet) is fixed to the lift beam 4, the positions of the other members can be adjusted. Inside the lift beam 4, a rodless cylinder 37 is fixed; and a piston of the rodless cylinder 37 is connected to the cradle 34 by a connecting member. The connecting member moves with the piston along a slit formed in the rodless cylinder 37 in the longitudinal direction, whereby the cradle 34 moves along the rails 38. Along with this, the rotatable base 33 moves together with the cradle 34, and rotates around the fulcrum 40 according to the location of the guide rail 39 because it is pushed by the spring 35; thereby the angle of the rotational circular blade is altered as shown by the dotted lines in FIG. 3. The angle of the rotational circular blade 31 is gradually inclined considering the inertia of the mass of moving parts, such as the cradle 34.

Figure 5:
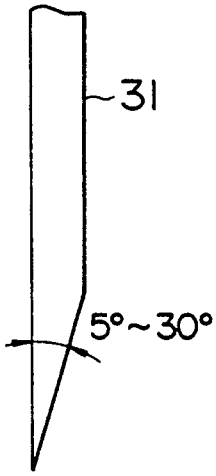
FIG. 5 shows the shape of a blade edge of the rotational circular blade.

The position of the guide rails 39 is selected to be most suitable in view of the velocities of movement of the sheet and that of the cradle 34 as well as other factors. The rotational circular blade 31 may have a suitable cross-sectional shape. However, when the circular blade is of double-edged type, the body part of the circular blade may contact with the sheet and break the sheet; therefore, it is preferred to employ a single-edged blade whose edge top angle is between about 5° and about 30° as shown in FIG. 5, and it is recommended to make the blade edge surface that is not inclined face toward the sheet edge side in the moving direction of the blade. When a single-edged circular blade having edge top angle less than 5° is employed, thickness of the blade may not afford sufficient rigidity to the blade for normal cutting; and when the angle exceeds 30°, the edge top may push the sheet too strongly and break the sheet.

The rotational speed of the circular blade has a strong influence on the cutting capacity. This will be explained below. For example, when a sheet is cut on the surface of a desk, one may note that it is more difficult to cut the sheet if the knife is fixed and the sheet is moved, as compared with the case where the sheet is fixed and the knife is moved. That is, it is better to move the knife. When the moving velocity of the sheet is 1000 m/min and the rotation of the circular blade is in the same direction with a peripheral speed of 1000 m/min, then the relative speed difference is zero, in which case it is difficult to cut the sheet. If the rotational direction of the circular blade is reversed with respect to the direction of sheet movement, the velocity ratio is increased. However, if the peripheral speed of the circular blade is slow, it is similar to the case where the sheet is moving while the knife is fixed; thus, the sheet cannot be cut well. Therefore, it is desirable to increase the peripheral speed of the circular blade relative to the sheet as much as possible. A speed greater than the running velocity of the sheet is preferred regardless of the rotational direction.

The degree of protrusion of the blade into the sheet, i.e., the amount of projection on the reverse side of the sheet, is preferably 1 mm or more. If it is less than 1 mm, the cutting edge of the circular blade may not touch the sheet surface if a part of the sheet with lower tension in the movement direction should pass during the cutting operation or if some vibration should develop. This will leave some uncut portions along the cut lines and cause problems.

While a rotational circular blade is employed for the cutting devices in this embodiment, a device using a high pressure water jet may be utilized as an alternative.

Instead of the rodless cylinder as a moving means of the cutting devices, they may be moved on guide rails by means of driven chains, wires, or the like, or other equivalent means can be adopted.

Figure 6:
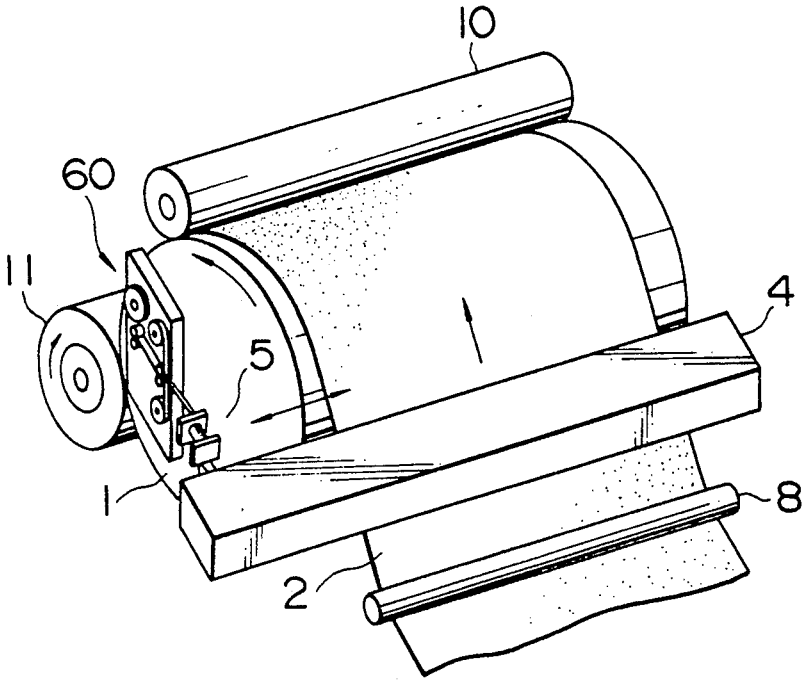
FIG. 6 is a perspective view showing the manner in which an adhesive label inserting device receives the next adhesive label from a label supplying device.

Now, a device for supplying an adhesive will be described. As shown in FIG. 6, this device comprises a label inserting device 5 disposed so as to slide along the lift beam 4, and an adhesive label supplying device 60 which is disposed on the side of the reel drum 1. As shown in FIG. 2, the label inserting device 5 comprises a lip part 51 for holding an adhesive label 55 of which both sides are adhesive, an air cylinder 52 for moving the lip part 51 forward and backward, and a holder part 53 for holding the air cylinder 52. The holder part 53 is disposed so as to slide along the lift beam 4 by engaging with a rotatable screw rod (not shown) fixed at the beam 4. In place of the screw rod as the moving device, a rodless cylinder, or wires or chains in combination with guide rails may be adopted. The lip part 51 may consist essentially of, for example, a flat spring and have an opening and closing mechanism which is pushed and opened by a protuberance disposed externally when the air cylinder 52 pushes the lip part 51. Alternatively, the lip part itself may include an opening and closing mechanism.

Figure 7:
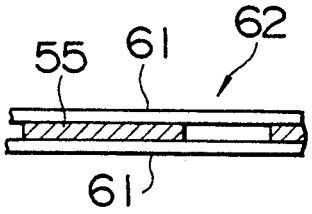
FIG. 7 shows the composition of an adhesive sheet.
Figure 8:
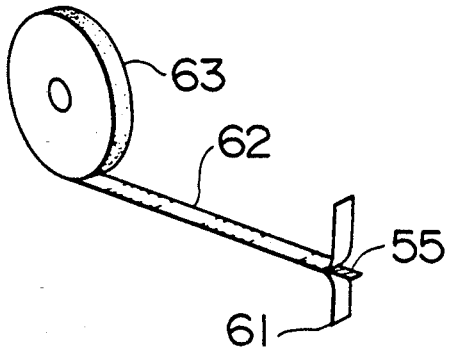
FIG. 8 shows the winding of an adhesive sheet.
Figure 9:
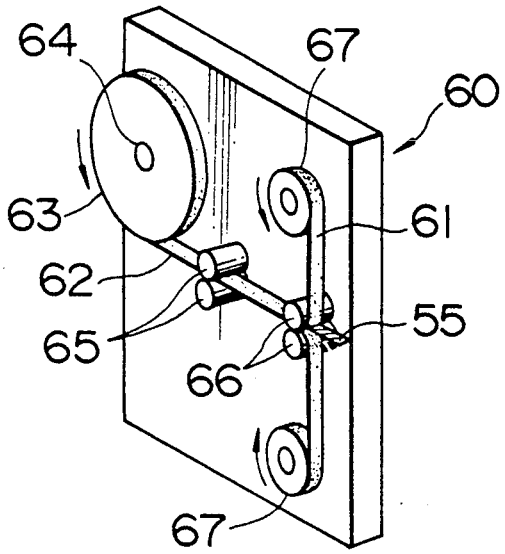
FIG. 9 is a perspective view showing the outline of assembly of the label supplying device.

Next, the adhesive label supplying device 60 will be described. As shown in FIG. 7, an adhesive sheet 62 comprising adhesive labels 55 inserted between two sheets 61 which can be peeled off is wound as a roll 63 as shown in FIG. 8. The roll 63 is fitted onto a sender 64 as shown in FIG. 9, whereby the adhesive sheet 62 is drawn to a constant length by nipping with feed rolls 65, 66. Then, the peel off sheets 61 on both sides are wound in opposite directions onto respective reels 67, whereby the adhesive label 55 is sent out. By repeating such operation, the adhesive labels 55 are sent out in succession. Then, the label inserting device 5 is moved to the center part of the sheet and waits after the lip part 51 receives the adhesive label 55 from the label supplying device 60.

While the adhesive supplying device may be composed as described in this embodiment, the device is not limited to this; a device fixed at the center part of the sheet may supply adhesive labels having adhesive on both sides into the apparatus in succession, or alternatively, a device may merely supply an adhesive paste without using such adhesive labels. Because if an adhesive paste is used as an adhesive it may become hard by the time the spool is changed next and cannot be supplied smoothly, it is preferable to use adhesive labels which are adhesive on both sides.

Figure 10:
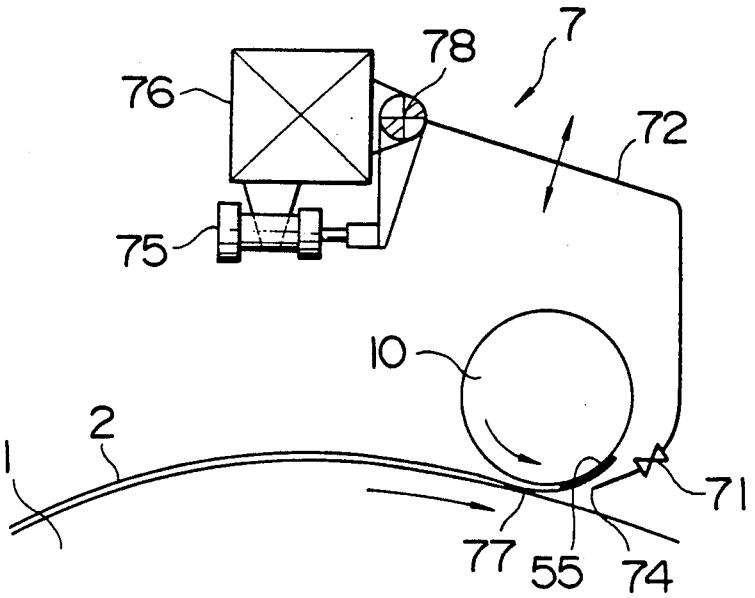
FIG. 10 is a detailed view of the jet cutting device of FIG. 2.

Next, the jet cutting device 7 will be described. In the jet cutting device 7 shown in FIGS. 10–12, the tip of a main nozzle pipe 72 is branched into two branch pipes 73, 73 which have throttle valves 71, 71, respectively. Nozzle openings 74, 74 at the tip of the branch pipes 73, 73 are directed to a center part of surface of the sheet 2 which is slightly downstream from the pressure contact point 77 where the new spool 10 comes into contact with the reel drum 1 as shown in FIG. 10. The nozzle opening 74 may be single instead of branched double as in the case of this embodiment. The tip of the main nozzle pipe 72 is fixed at a rotation fulcrum 78 disposed on a cross frame 76. By means of an air cylinder 75 fixed onto the cross frame 76, the main nozzle pipe 72 is turned around as shown by the arrow mark in FIG. 10, whereby the main nozzle pipe 72 can move to a standby position away from the locus of outer peripheral rotation of the new spool 10.

Figure 12:
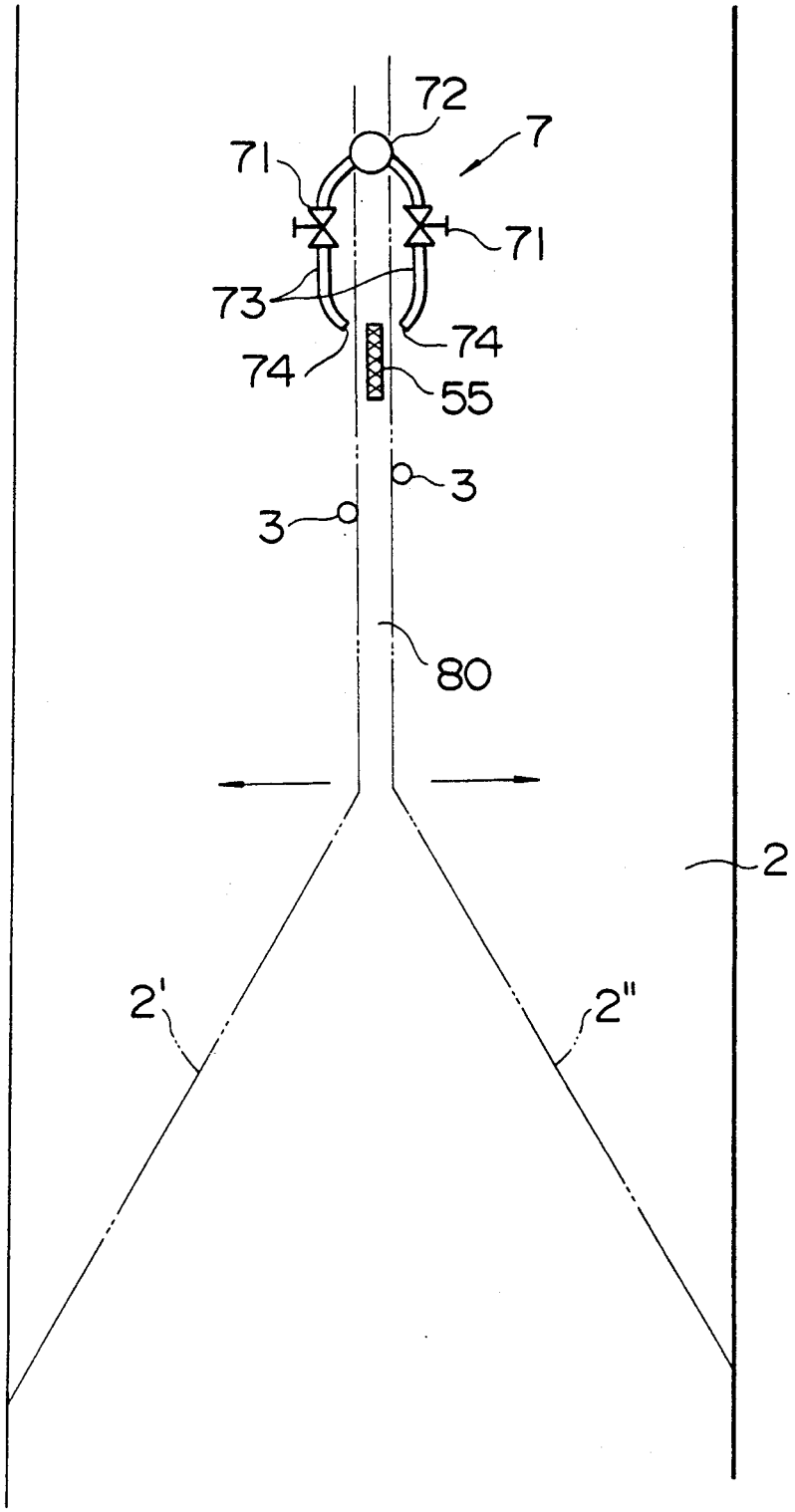
FIG. 12 shows how a triangular shape of the sheet is cut out.

Next, the operation will be described. At first, when the desired amount of sheet 2 has been wound onto the winding roll 11 which is taking up the sheet and which is located on the horizontal rail 12 in contact with the reel drum 1, the procedure for replacing a spool begins. First, the main nozzle pipe 72 of the jet cutting device 7 rotates around the rotation fulcrum 78, whereby the nozzle openings 74, 74 of the branch pipes 73, 73 are moved to a location directing at the center part of the sheet surface and become ready for the air jet injection. Depending on the conditions, a single jet may be applied by closing one throttle valve 71. The primary arm 9 in the waiting position inclines nearly simultaneously with the above-mentioned actions, and the new spool 10 comes into contact with the reel drum 1 and begins to rotate. Along with the movement of the jet cutting device 7, the lift beam 4 swings downward by action of the air cylinder 6, whereby the rotational circular blades 31 of the two cutting devices 3, 3 come in contact with the sheet 2. That is, the rotational circular blades 31 rotated by the motor 32 are brought into contact with the sheet 2 and cut it, so as to form two parallel cut lines and thus a leading ribbon 80 of predetermined narrow width with the movement of the sheet 2 as shown in FIG. 12. The tip end of the leading ribbon 80 is connected with the main part of the sheet 2 without being separated.

As mentioned above, the cutting devices 3, 3 cut and form the leading ribbon 80, and when the ribbon part reaches the pressure contact point (at this time, the new spool is already in contact with the reel drum 1 by the lowering of the primary arm 9), the label inserting device 5 waiting at the center part of the sheet, while holding the adhesive label 55 at the lip part 51, inserts the holding adhesive label between the leading ribbon 80 of the sheet 2 and the new spool with the forward movement of the lip part 51 caused by the air cylinder 52. The adhesive label 55 with adhesive on both sides is pressed therebetween, and the leading ribbon 80 adheres and transfers onto the new spool.

As another method for supplying adhesive labels, the following steps can also be taken: an adhesive label 55 is transferred onto the leading ribbon 80 by softly pressing the label inserting device 5 which is holding the adhesive label against the leading ribbon 80 when the cutting devices 3, 3 start to form the leading ribbon 80. Subsequently, when the leading ribbon 80 on which the adhesive label is now attached reaches the pressure contact point 77 formed between the reel drum 1 and the new spool 10, the leading ribbon 80 is adhered and transferred to the new spool.

However, it is normally preferred to adopt the former method (of the two methods just described) of inserting the adhesive label at the pressure contact point between the leading ribbon and the new spool, because it can assure the adhesion of the leading ribbon and the new spool more securely.

The leading ribbon 80 is now attached to the outer periphery of the new spool 10 at the contact point 77 between the reel drum 1 and the new spool 10 with the inserted adhesive label 55, and the leading ribbon 80 starts to be wound around the new spool 10. At this point of time, the leading ribbon 80 preceding the adhered portion is lifted, and the air jet ejecting from the nozzle openings 74, 74 hits the lifted part, whereby the leading ribbon 80 is cut off.

Nearly simultaneously with the actions described above, the cutting devices 3, 3 move very quickly toward the respective left and right sides since a fluid pressure is applied to pistons (not shown) of the rodless cylinder 37 and the cradle 34 moves along the rails 38 along with the respective pistons.

With the movement of the cradle 34, the guide roll moves along the guide rail 39 as it is pushed by the spring 35, so that the rotatable base 33 rotates around the fulcrum pin 40 and the rotational circular blade 31 is inclined with respect to the sheet movement direction. During these procedures, the sheet moves continuously to the downstream direction and the cut lines of the sheet 2 formed by the cutting devices 3, 3 become oblique lines 2', 2'', whereby the sheet 2 is cut in a triangular shape.

The sheet 2 headed by the adhered portion is wound onto the new spool without any slack. On the other hand, the old roll 11 having finished the winding is separated from the following sheet 2 along the double dotted lines 2', 2'' in FIG. 12, as explained above. Thus, the old winding roll 11 is rotated on the horizontal rail 12 away from the reel drum and removed to the next step.

Figure 11:
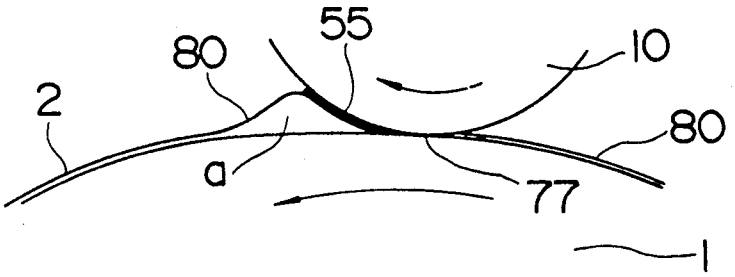
FIG. 11 shows how the sheet is cut by the jet cutting device.

Now, the manner in which the leading ribbon 80 is cut off by the air jet ejecting from the nozzle openings 74, 74 will be described in more detail. At the moment when the adhesive label 55 is inserted to the pressure contact point 77 with the label inserting device 5, and the new spool and the leading ribbon 80 are pressed together with the adhesive label therebetween, or at the moment when the adhesive label 55 attached on the leading ribbon 80 reaches the pressure contact point 77 of the new spool 10 and is attached thereto under pressure, the leading ribbon 80 is lifted toward the new spool 10 as shown in FIG. 11, so that a space "a" is formed. Toward the space "a", the high pressure air jet (max. 10 kg/cm$^2$, usually 3-4 kg/cm$^2$) is injected from the nozzle openings 74. That is, the injection is directed into the space "a" from the cut parts on both sides of the leading ribbon 80. By the dynamic pressure, a paper with less than 100 g/m$^2$ is cut off at the tip end of the label 55 of the leading ribbon 80, whereby the winding of the sheet 2 onto the new spool 10 proceeds without slack.

In the case of thick paper of 100 g/m$^2$ or more, peeling between paper layers may happen depending on the type of paper. However, because of the lifting force acting on the peeled upper layers from the leading ribbon 80 attached on the new spool, the peeled lower layers are also lifted. Thus, a space is formed between the surface of the reel drum 1 and the paper sheet similarly to FIG. 11, and the lower layer sheet is cut off together with the upper layers. Then, the sheet is wound onto the new spool without slack by means of the leading ribbon and the triangular part.

As explained hereinabove, a sheet of the tip end is shaped into a convex triangle can be always obtained by the method for changing spools and the apparatus therefor of the present invention. The sheet winding onto the spool can be done very smoothly.

Accordingly, the winding of a sheet onto the spool can be done in a minimum period of time, without generating large amounts of defective sheets. Thus, excellent production efficiency can be attained, and the workload of operators can be reduced to a large extent compared with conventional methods Moreover, paper rolls of good quality can be produced with stability and with very few defects because sheet folding is effectively prevented. Therefore, the method and apparatus of the present invention are particularly effective for strong paper.

We claim:

1. A method for changing spools in which a sheet continuously supplied to a reel drum is wound onto a new spool, comprising the steps of:

bringing the new spool from a waiting position into contact with the reel drum at the time for replacing the spool, said drum having an upstream side forward of the point of contact with said spool and a downstream side past the point of contact with said spool;

cutting the center part of said sheet with two cutting devices along two approximately parallel cut lines to form a leading ribbon on the upstream side of said reel drum in the direction of sheet movement;

moving said cutting devices after forming said leading ribbon to the respective side edges of said sheet to cut said sheet along oblique lines on the upstream side of said reel drum in the direction of sheet movement;

applying a two-sided adhesive label to said leading ribbon on the upstream side of said reel drum whereby said label engages with said new spool upon movement of said sheet and becomes sandwiched between said ribbon and said spool for lifting and adhering said ribbon to said spool; and cutting the lifted part of said leading ribbon by an independent cutting device at a location slightly downstream from the point where said new spool comes into contact with said sheet on the downstream side of said reel drum.

2. A method for changing spool as in claim 1, wherein said two cutting devices have rotational circular blades, and the angular position of said blades relative to the plane of said sheet is changed to first cut said leading ribbon and thereafter cut the leading edges of said sheet immediately upstream of said ribbon into a triangular shape.

3. A method for changing spools as in claim 2, wherein the rotational velocity of said rotational circular blades is greater than the moving velocity of said sheet.

4. An apparatus for changing spools in which a sheet continuously supplied to a reel drum is wound onto a new spool, said apparatus comprising:

holding and positioning means for holding the new spool at a waiting position and for bringing said new spool into contact with said reel drum when spools are replaced, said drum having an upstream side forward of the point of contact which said spool and a downstream side past the point of contact with said spool;

cutting means including a pair of support frames each having a cutting blade supported for movement thereon to define a pair of such blades disposed for movement to engage with said sheet to form a leading ribbon on the upstream side of said reel drum in the direction of sheet movement;

said cutting means, after forming said leading ribbon, effecting movement of said pair of cutting blades to the respective side edges of said sheet;

label means for applying a two-sided adhesive label to said leading ribbon on the upstream side of said reel drum, said label being disposed to engage with said new spool upon movement of said sheet and become sandwiched between said ribbon and said spool for lifting and adhering said ribbon onto said spool; and jet cutting means disposed for movement between a standby position and an operate position, said cutting means in its operate position being disposed to direct a fluid medium jet on a lifted part of said leading ribbon at a location slightly downstream from the point where said new spool comes into contact with said reel drum for severing said ribbon from said sheet on the downstream side of said drum.

5. An apparatus for changing spools as in claim 4, wherein said cutting blades are rotational circular blades.

6. An apparatus for changing spools as in claim 5, wherein said cutting means includes means for changing the angular position of said rotational circular blades relative to the plane of said sheet whereby said leading ribbon is defined by parallel cut lines and movement of said blades thereafter to the respective side edges of said sheet is along oblique lines.

7. An apparatus for changing spools as in claim 5, wherein said rotational circular blades are single-edged blades whose edge top angle is inclined between 5° and 30°, the blades being oriented with the non-inclined flat surface thereof facing the respective side edges of said sheet.

8. An apparatus for changing spools as in claim 4, wherein said jet cutting means comprises a nozzle ejector for ejecting a high pressure water jet.

9. An apparatus for changing spools as in claim 4, wherein the support frames of said cutting means comprise rail members, said cutting means further comprising a cradle positioned on said rail members for movement thereon, a base member rotatably mounted on said cradle, a motor fixedly mounted to said base member and having an output shaft, one of said cutting blades connected to said output shaft for rotation therewith, guide linkage members having one end operatively connected to said rotatable base member, spring biasing means disposed between said rotatable base member and said cradle for urging said base member in the direction for said guide linkage members, and piston means operatively connected to said cradle for moving said cradle on said rail members, whereby movement of said cradle effects rotational movement of said base member thereby changing the angular position of said cutting blade relative to the plane of said sheet.

* * * * *